United States Patent [19]

Werkes et al.

[11] Patent Number: 4,540,987

[45] Date of Patent: Sep. 10, 1985

[54] AERIAL TOWED BATTLE TARGET

[75] Inventors: Heinz Werkes, Greding; Hubert Nöhren, Hamburg, both of Fed. Rep. of Germany

[73] Assignee: Autoflug GmbH, Rellingen, Fed. Rep. of Germany

[21] Appl. No.: 597,435

[22] Filed: Apr. 6, 1984

[30] Foreign Application Priority Data

Apr. 9, 1983 [DE] Fed. Rep. of Germany ..... 3312820

[51] Int. Cl.[3] ..... F41J 9/10

[52] U.S. Cl. ..... 343/18 B; 244/1 TD; 273/360

[58] Field of Search ..... 244/1 TD; 273/360, 361; 343/13 R, 18 B

[56] References Cited

U.S. PATENT DOCUMENTS

| | | | |
|---|---|---|---|
| 1,860,982 | 5/1932 | Binnie | 273/360 |
| 2,402,156 | 6/1946 | Griesinger | 273/360 |
| 2,412,562 | 12/1946 | Crawshaw | 343/18 B |
| 2,731,046 | 1/1956 | Bachner | 428/389 X |
| 2,907,095 | 10/1959 | Frey | 273/360 X |
| 4,184,681 | 1/1980 | Graham, Jr. | 244/1 TD X |
| 4,195,798 | 4/1980 | Costantino et al. | 244/1 TD |
| 4,205,848 | 6/1980 | Smith et al. | 273/361 |

*Primary Examiner*—Henry F. Epstein

*Attorney, Agent, or Firm*—Becker & Becker, Inc.

[57] ABSTRACT

An aerial towed battle target having a mechanism for radar detection and including a hollow body which is reinforced in the front in a ring-like manner and is composed of sewn together woven lengths of fabric into which are integrated elongated metal elements. The hollow body has a base and towing gear associated with the front. The problem with heretofore known targets is locating and taking bearings with shortwave radio beams during approach and take-off when the direction of flight coincides extensively with the beam direction. To improve the inventive target in this respect, the elongated metal elements are contained in the fabric lengths as weft threads which are disposed essentially transverse to the direction of towing. These metal weft threads are incorporated between the woven weft threads, with the spacing between the metal threads increasing over the length of a woven fabric pattern uniformly from a relatively small dimension to a relatively large dimension. With regard to the increase of the spacing between the picked or shot-in metal elements, the fabric lengths are alternately reversed.

13 Claims, 4 Drawing Figures

AERIAL TOWED BATTLE TARGET

BACKGROUND OF THE INVENTION

1. Field of the Invention

The present invention relates to a battle target which is in the form of an aerial towed (sleeve) target, has a mechanism for radar contact, and comprises a hollow body which is reinforced in front in a ring-shaped manner and is composed of sewn together woven lengths of fabric in which are integrated elongated metal elements; the hollow body has a base, and has towing gear associated with the front end thereof.

2. Description of the Prior Art

A towed target of this general is known from German Offenlegungsschrift No. 26 02 432. The elongated metal elements thereof are disposed on the hollow body at intervals of less than or up to one-fourth of the wave length of the radar frequency which is utilized. Elongated metal elements which are typically used are metal threads, with individual woven threads of the fabric being twisted or wrapped around by a metal thread and extending either in the warp or weft direction, or even in both directions. The reflection, and hence the discovery and pick-up of the target, are improved with these heretofore known measures.

Also known (German Gebrauchsmuster No. 17 91 564) is a radarsensitive target fabric, the warp and/or weft of which contains metallic wires or yarns. In particular, the base fabric of the target comprises monofilament polyethylene wires, with three bronze wires which comprise a plurality of individual wires being alternately picked or shot-in with three polyethylene wires. Similar subject matter is disclosed in U.S. Pat. No. 2,731,046 Bachner dated Jan. 17, 1956, according to which individual polyethylene filaments have wound therearound or are coated with metal, such as aluminum. In all of the aforementioned situations, at least individual fabric threads can be provided with contrasting colors in order to highlight them optically.

Although the heretofore known towed targets may allow for sufficient detectability due to well-focused short wavelength radio beams (radar beams) as the target flies by, nonetheless more or less great difficulties occur if the target is already to be located and its bearing taken during approach or while it is still in take-off, i.e. in directions of flight which increasingly approach the direction of the radio waves until they coincide therewith. The radio waves then no longer strike a surface which is disposed transverse thereto, but rather in the extreme case only strike the thin end edge of the woven lengths of fabric of the associated target, so that with these heretofore known means no utilizable reflection can be achieved. Although this is of no great significance for slow-moving targets, since there is sufficient time to discover and pick-up the target as it flies by, rapidly flying targets must be located and picked-up already at a great distance or range during approach as well as during take-off since the time available as the target flies by is much too short for launching defense devices. Furthermore, a target seldom actually flies past; mainly, a direct approach and take-off occur, so that only the end faces of the flying object, or projections thereof, are available for location and taking of a bearing. In such cases, even aircraft-like shaped targets, as described in the periodical "Flugkörper", issue 2-1961, pages 58 and 59, offer only reduced reflection conditions.

It is an object of the present invention to improve the detectability, by radio beams, of an aerial towed battle target of the aforementioned general type during approach and take-off, and in so doing to still make it a usable object at the least possible expense.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

The aerial towed battle target of the present invention is characterized primarily in that the elongated metal elements in the length of fabric are weft threads that are disposed essentially transverse to the direction of towing; these metal weft threads are incorporated between the woven weft threads, with the spacing between the metal elements, over the length of a woven fabric pattern, increasing according to a mathematical principle from a relatively small dimension to a relatively large dimension, beginning at the front, at the back, or somewhere in between relative to the hollow body.

Pursuant to further advantageous specific features of the present invention, the woven lengths of fabric alternately can be disposed in reverse order relative to the increase of the spacing between the picked or shot-in metal elements. Both ends of a given length of fabric can be provided with a seam allowance which contains no metal elements.

Both ends of a given fabric length pattern also can be provided with a seam allowance which includes the increasing spaced apart pattern of the metal elements. The respective fabric length pattern can be made into the hollow body without regard to the two pattern ends coinciding with the front and rear ends of the hollow body.

The fabric lengths of the hollow body can be cut in trapezoid-shaped sections with sections of one and the same pattern of the textile material which is in the production width being placed adjacent one another, with the longitudinal edges thereof being sewn together to form the hollow body.

The shot-in elongated metal elements, especially metal threads, may be intertwined with yarn which contrasts in color relative to all of the other threads.

The fabric lengths may be provided with elongated metal elements which extend not only in the direction of towing, but also essentially transverse to the direction of towing. The elongated metal elements of the fabric lengths which extend in the direction of towing may be combined with the warp threads of the fabric, for example by being intertwined therewith, or may even comprise these warp threads. The warp threads of the fabric may be disposed in an alternating pattern with and without metal elements. For example, one warp thread may be provided with metal elements, and the next four warp threads may be provided without metal elements.

The target of the present invention has the advantage that it is capable of reflection in the same manner not only during approach but also during take-off, and can be produced economically in large quantities without regard on the one hand to the length of the target, and on the other hand to the technical requirements during manufacture of the associated woven fabric, especially the pattern thereof. In particular, due to the present invention, the manufacture of the cut-to-size lengths for the fabric of the hollow body can be undertaken at very little expense.

DESCRIPTION OF PREFERRED EMBODIMENTS

Figure 1:
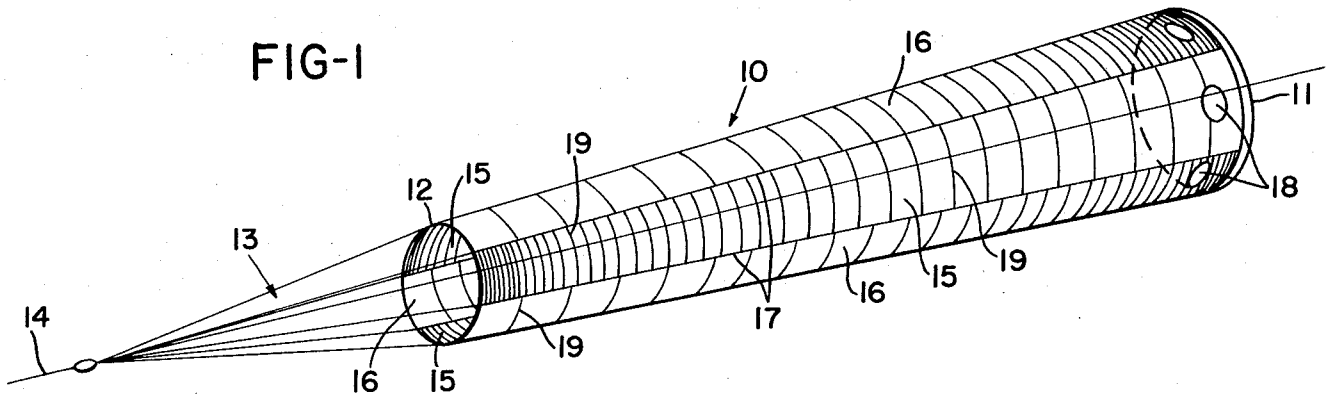
FIG. 1 is a diagrammatic view of one inventive embodiment of an aerial towed battle target with the towing gear on the left.
Figure 3:
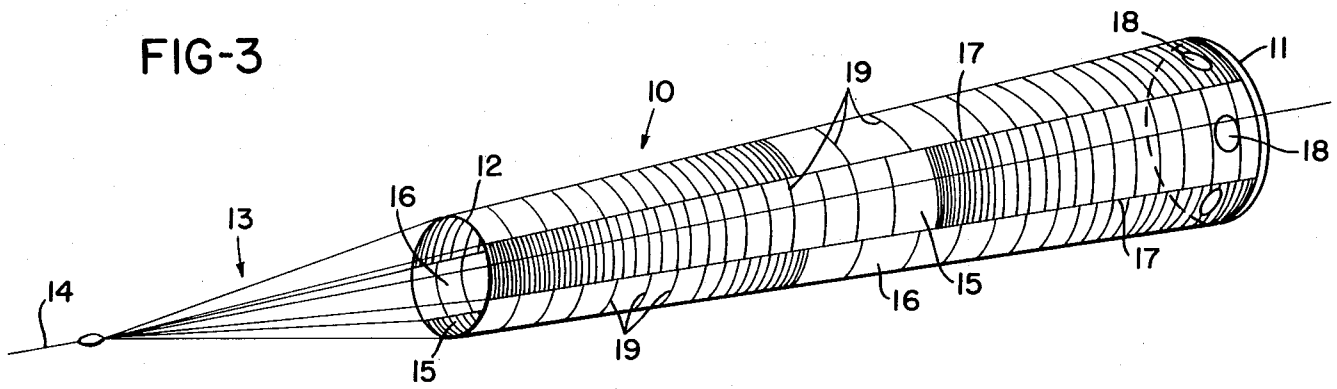
FIG. 3 is a diagrammatic view of a further inventive embodiment of an aerial towed battle target with the towing gear on the left.

Referring now to the drawings in detail, and in particular to FIGS. 1 and 3, the battle targets in the form of aerial towed sleeve targets respectively shown therein each comprises a very elongated truncated-cone-shaped hollow body 10 which has a closed base 11 and towing gear 13 which is applied at the front end 12; a towing line 14 of the non-illustrated towing aircraft is secured to the towing gear 13, which is called a "spider".

The hollow body 10 comprises a plurality of longitudinally extending, woven lengths of fabric 15, 16, and in the illustrated examples of FIGS. 1 and 3, comprises six lengths of fabric which are sewed together along their longitudinal edges. This results in six material seams 17; in conformity with this number of seams, the towing gear 13 also has six lines. In the vicinity of the base 11 of the towed target each length of fabric 15, 16, is provided with an air opening 18. The material of the base 11 is more air permeable than the material of the fabric lengths 15, 16, which are to allow as little air through as possible, with the inside of the hollow body 10 therefore additionally being coated, for example with acrylic resin.

The woven lengths of fabric 15, 16 comprise a conventionally woven material having warp and weft threads. The threads, for example, can be produced from acrylonitrile fibers. The material illustrated in FIGS. 2 and 4 can, for example, have a width of 1.40 m. Each warp thread spaced a maximum quarter wave of the utilized radar frequency (for example 9–30 GHz which is an abbreviation for gigacycles/second or $10^9$) from the corresponding next warp thread, for example each seventh warp thread, is metallized, for example by being intertwined with a metal thread. Elongated metallic elements are also provided for a portion of the weft threads, and in particular with the illustrated embodiments, metal threads 19 of so-called Lamé quality are used. The distances of the picked or shot-in metal threads 19 from one another are not uniform. Instead, these distances increase according to a mathematical interrelationship from a relatively small minimum distance, for example 1 mm, to a relatively large maximum distance, for example 150 mm; in the drawings, this is illustrated by appropriately separated lines.

Figure 2:
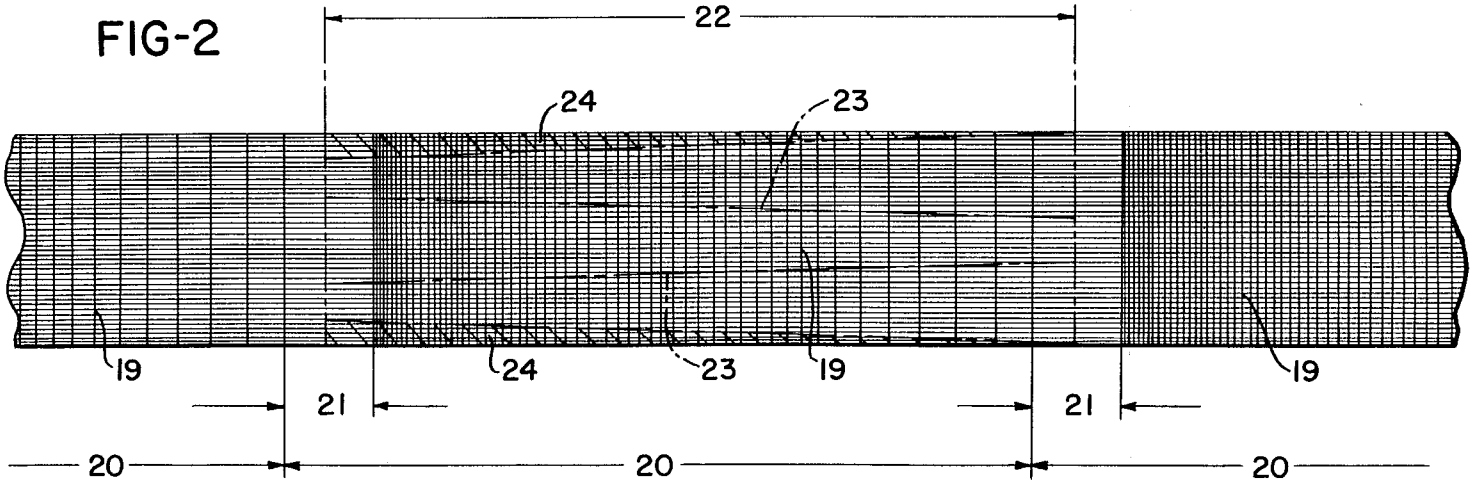
FIG. 2 is a plan view of a portion of a woven length of fabric during manufacture showing the pattern, seam allowance, and the cut-to-size length.
Figure 4:
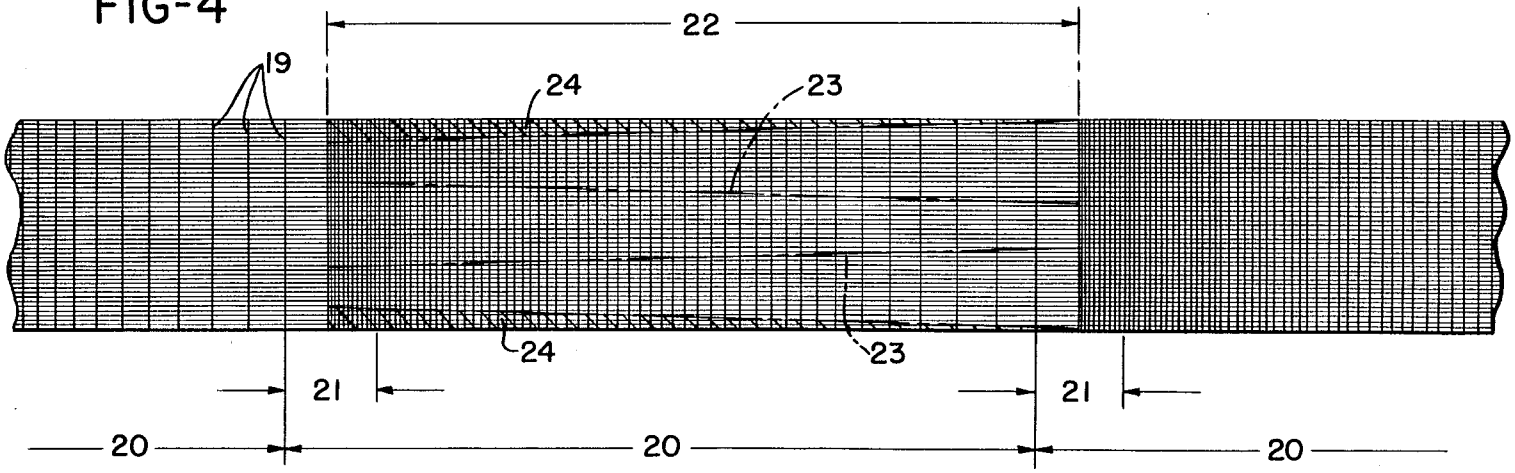
FIG. 4 is a plan view of a portion of a woven length of fabric during manufacture showing the pattern and the cut-to-size length, but without a free seam allowance.

As shown in FIGS. 2 and 4, a complete rhythm or pattern of picked or shot-in metal threads 19 between the outermost threads having minimal spacing on the one hand and the outermost threads having maximum spacing on the other hand forms a pattern or repeat 20 on the woven fabric. A seam allowance 21 is additionally provided on the side of the minimum spacing of the metal threads 19 (in the drawings, on the left side), so that the pattern 20 includes the seam allowance 21. In FIG. 2, the seam allowance 21 does not have any metal weft threads, so that an empty region exists there between the respective pattern ends having the maximum spacing of metal threads 19 and the next beginning of the weft thread pattern having the minimum spacing. Although a seam allowance 21 is also provided in the woven fabric of FIG. 4, this particular seam allowance contains metal weft threads 19, i.e. these threads continue in the seam allowance in the proper pattern.

At the end of the pattern side having the maximum spacing of the metal threads 19 (on the right side in FIGS. 2 and 4), the next pattern begins again with a suitable seam allowance, etc. Each blank or cut-to-size length 22 (usable length) extends from the transverse middle to the transverse middle of successive seam allowances 21. In this way corresponding strips of fabric are available for enclosing non-illustrated annular reinforcements at the front end 12 of the hollow body 10 and for sewing the base 11. In the illustrated embodiments of FIGS. 2 and 4, the pattern 20, and the cut-to-size length 22, is approximately 3.80 m long.

As indicated in FIGS. 2 and 4 by the dot-dash lines 23, the lengths of fabric 15, 16 of the hollow body 10 are cut out of a given pattern 20 as oppositely disposed trapezoids. In this manner, only small waste wedges or portions 24 result which do not affect the economy of the manufacture. The cutting lines 23 directly result on the one hand in the fabric lengths 15 having minimum spacing of the metal weft threads 19 on the front side of the target, and in the fabric lengths 16 having the minimum spacing of the metal threads 19 on the back side of the target. Connected herewith is the already explained effect that the target can already be located and its bearing taken during approach and take-off, at, for example, 10 km range. The longitudinal seams 17 necessarily fit together, so that no difficulties, such as the formation of creases, can occur during manufacture.

In the embodiment of FIG. 4, a seam allowance which is free of metal weft threads is dispensed with. This embodiment has the advantage that the metal weft threads 19 do not have to be interrupted; rather, the respective outermost metal threads 19 at the end of the pattern having the maximum spacing is directly adjacent the outermost metal threads of the portion having the minimum spacing. Without changing the effect of the radial beam reflection due to the linear arrays in the two critical directions of flight, namely approach and take-off, this embodiment offers the possibility, without particular expense, of being able to produce targets having lengths which differ from the length of the pattern 20, so that also the cut-to-size length 22 no longer coincides with the pattern 20. In such a case, any portion of the fabric length in FIG. 4 can be used as the seam allowance and can be cut, with the spacing of the metallic weft threads 19 at this location not mattering.

A target of this type is illustrated in FIG. 3. The pattern of the metal threads 19 does not only start at one end of the hollow body 10, but rather also restarts in the middle region of the pertaining fabric lengths 15, 16 with a minimum spacing and extends to such an extent in the direction of maximum spacing until it coincides with the length of the hollow body 10. In this connection, the respective lengths of fabric 15 and 16 can have different lengths with regard to the pattern from the minimum to the maximum spacing of the weft threads 19. This offers a wide number of possibilities for embodiments of hollow bodies 10 having fabric lengths 15, 16 without affecting the desired action as long as the pattern of the picked or shot-in metal threads 19 alternates from one fabric length to the next, first in one direction and then in the other. This brings with it considerable savings during manufacture.

The present invention is, of course, in no way restricted to the specific disclosure of the specification and claims, but also encompasses any modifications within the scope of the appended claims.

What we claim is:

1. An aerial towed battle target in combination therewith having a mechanism for radar detection; comprising:

a hollow body having a base, a front end which is remote from said base and is reinforced in a ring-like manner, and a towing gear associated with said front end; said hollow body further comprising woven lengths of fabric which are sewn together; said woven lengths of fabric contain woven warp and weft threads, and elongated metal elements in the form of metal weft threads which are incorporated between some of said woven weft threads; said metal weft threads are essentially disposed transverse to the direction of towing, and are spaced from one another, along the length of a given woven fabric patern, by non-uniform distances which increase, according to a mathematical principle of relationship ranging from a relatively small minimum dimension of 1 mm to a relatively large maximum dimention of 150 mm beginning somewhere along the length of said hollow body so that radar reflection, and hence discovery and pick-up of the target are improved especially herewith.

2. A target in combination according to claim 1, in which said lengths of fabric of said hollow body are alternately disposed in reverse order with regard to the increasing spacing between said metal weft threads.

3. A target in combination according to claim 2, in which a seam allowance which is free of said metal elements is provided at both ends of a given woven fabric pattern.

4. A target in combination according to claim 2, in which both ends of a given woven fabric pattern are provided with a seam allowance which includes the increasing spacing pattern of said metal elements.

5. A target in combination according to claim 4, in which said hollow body includes woven lengths of fabric which are incorporated therein without regard to having the ends of a given fabric pattern coincide with the ends of said hollow body.

6. A target in combination according to claim 2, in which said lengths of fabric are trapezoidal-shaped sections cut from one and the same pattern of a woven material of production width, with the longitudinal edges of said sections being placed next to one another and sewn together to form said hollow body.

7. A target in combination according to claim 2, in which said metal elements are intertwined with yarn which contrasts in color with all of the other threads of said hollow body.

8. A target in combination according to claim 2, in which said metal elements are disposed not only transverse to the direction of towing, but also extend in the direction of towing.

9. A target in combination according to claim 8, in which said metal elements which extend in the direction of towing are connected with at least some of said woven warp threads.

10. A target in combination according to claim 9, in which said metal elements which extend in the direction of towing are intertwined with said woven warp threads.

11. A target in combination according to claim 8, in which said metal elements which extend in the direction of towing comprise said woven warp threads.

12. A target in combination according to claim 9, which includes warp threads alternately provided with and without metal elements.

13. A target in combination according to claim 12, which includes, in a repeating pattern, one woven warp thread with metal elements, and four woven warp threads without metal elements.

* * * * *